US007685780B2

(12) United States Patent
Adams

(10) Patent No.: US 7,685,780 B2
(45) Date of Patent: Mar. 30, 2010

(54) MOLDED PLASTIC CANOPY

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 1161 days.

(21) Appl. No.: 11/171,530

(22) Filed: Jun. 30, 2005

(65) Prior Publication Data

US 2007/0000186 A1 Jan. 4, 2007

(51) Int. Cl.
*E04B 1/34* (2006.01)

(52) U.S. Cl. ..... 52/75; 52/78; 52/199; 52/302.1

(58) Field of Classification Search ..... 52/74, 52/75, 76, 78, 11, 12, 198, 199, 302.1; 454/250; 160/49, 57, 157
See application file for complete search history.

(56) References Cited

U.S. PATENT DOCUMENTS

| | | | | | |
|---|---|---|---|---|---|
| 1,087,490 | A * | 2/1914 | Henry | 52/63 |
| 1,401,080 | A * | 12/1921 | Hobelmann | 52/74 |
| 2,533,846 | A * | 12/1950 | Stone | 52/74 |
| 2,626,435 | A * | 1/1953 | Speck | 52/74 |
| 2,690,599 | A | 10/1954 | Thompson et al. | |
| 2,749,580 | A * | 6/1956 | Coburn | 52/74 |
| 2,814,842 | A | 12/1957 | O'Morrow | |
| 3,015,861 | A | 1/1962 | Hupp | |
| 3,869,838 | A | 3/1975 | Tedesh | |
| 5,509,236 | A | 4/1996 | Angles | |
| D384,167 | S * | 9/1997 | Bodeau | D25/57 |
| 5,873,202 | A | 2/1999 | Parks | |
| 6,536,165 | B2 * | 3/2003 | Pilcher | 52/12 |
| 6,591,556 | B2 | 7/2003 | Bertheaume et al. | |
| 7,250,000 | B2 * | 7/2007 | Daniels, II | 454/250 |
| 2003/0024173 | A1 | 2/2003 | Cohen | |
| 2004/0177565 | A1 | 9/2004 | Wesdock | |

* cited by examiner

*Primary Examiner*—Richard E Chilcot, Jr.
*Assistant Examiner*—Chi Q Nguyen
(74) *Attorney, Agent, or Firm*—Buchanan Ingersoll & Rooney PC

(57) ABSTRACT

A lightweight, molded plastic canopy has a sloped or peaked roof and mounting flanges that enable the canopy to be attached to an exterior wall above a door. The canopy is configured so that several canopies can be nested together for display and shipment.

11 Claims, 7 Drawing Sheets

MOLDED PLASTIC CANOPY

FIELD OF INVENTION

The invention relates to canopies that are attached above the outside door of a building to protect the door and people standing in front of the door from rain and sun.

BACKGROUND OF THE INVENTION

It has been common practice for many years to provide a canopy above an outside door to a building to shield the door and people standing in front of it from rain, snow and sun. One type of canopy is made on site by a carpenter who builds a frame, places a wood or plywood top on the frame and covers it with shingles or other roofing material. Typically, this structure is built in place. Yet another type of canopy is a canvas awning that is hung on a tubular frame attached to the wall of the building above the door. Both types of canopies require some skill in assembling and mounting the canopy. Even a skilled carpenter or craftsman may take several hours to build and install these prior art canopies. For the average homeowner it may be a one or two day project.

Exterior doors typically are 32 inches, 36 inches or 42 inches wide. A canopy which extends over such a door must be at least 2 inches and preferably 4 to 6 inches wider than the width of the door. In addition the canopy typically should extend out at least 36 inches from the door. Therefore, a typical canopy would be at least 3 feet by 3 feet and may have a height of anywhere from 8 to 36 inches. However, much longer structures which cover a porch having a length and width of several feet could be considered a canopy.

Products sold in retail home centers and building supply stores are typically shipped from the manufacturer on pallets. Both the manufacturer and the retailer prefer that several items be arranged on a single pallet to save space both in the store and during shipping.

Hupp in U.S. Pat. No. 3,015,861 discloses a one piece molded awning which fits around a window frame. The awning is held in place by nailing three edges of the awning to the top, right side and left side of the window frame. Because of its configuration the one piece molded awning disclosed by Hupp is not suitable for attachment above an exterior door. It can only be attached to a window frame. Furthermore, the one piece awning has a shape such that it is not possible to nest several awnings one on top of one another on a pallet for shipping and storage. For shipment, each must be individually boxed to protect from damage.

Thompson et al. in U.S. Pat. No. 2,690,599 disclose a canopy for attachment above an exterior door. This canopy has multiple pieces which must be assembled on a frame and is not plastic. Other multi piece canopies are disclosed by Bertheaume et al. in U.S. Pat. No. 6,591,566. This canopy is intended to be hung on a single pole.

There is a need for a molded plastic canopy which is sufficiently light in weight that the canopy could be easily installed above an exterior door. The canopy should be such that multiple canopies could be nested and stacked on a pallet for shipment and display at a retail location.

SUMMARY OF THE INVENTION

I provide a molded plastic canopy shaped so that it is stackable when manufactured, transported, warehoused, and passes through the retail distribution chain. A mounting section allows the canopy to be easily fastened above the door. It may be a flange that extends from one edge of the roof such that an angle between the inside surface of the mounting flange and the bottom surface of the roof is an acute angle. Or, fasteners may be attached to the house on which the canopy rests and to which it is secured. At least one sidewall extends from one or two other edges of the roof. In one embodiment, the mounting flange is used to attach the roof to an exterior wall above an exterior door. In another embodiment a second mounting flange is provided on a side of the roof adjacent the side from which the first mounting flange extends. Two of these roof structures may be assembled to form a peaked roof by attaching the two mounting flanges together or by being molded together.

I prefer to provide a gutter along at least one edge of the roof. I also prefer to configure the roof to simulate a shingled roof, shake roof, metal roof or tile roof. I also prefer to provide a flexible web above the mounting flange such that the web will press against the surface of the wall on which the canopy is attached.

Optionally, I may provide braces, sidewalls and mounting brackets for a light fixture or other accessories. The sidewalls may be a simple triangular pieces or ornate structures having designs or scalloped edges or other visibly pleasing features. These pieces and structures preferably are molded plastic. If the side support is made from a pipe-like piece of metal, wood, or plastic resin, it may have a built-in extender so that it can be fastened to the house, and extended into mating spaces in the canopy for easy, secure, adjustable mounting.

I further prefer to provide a vent in the roof of the canopy. I also may provide a solar cell that could be molded into or attached onto the roof to charge a battery for a light fixture, ventilator, or weather recording fixture(s), or other electrical applications. Attachments for bird feeders, wind chimes and other decorations may be part of the product.

Other objects and advantages of the invention will become apparent from the description of certain present preferred embodiments shown in the drawings.

DESCRIPTION OF THE PREFERRED EMBODIMENTS

Figure 1:
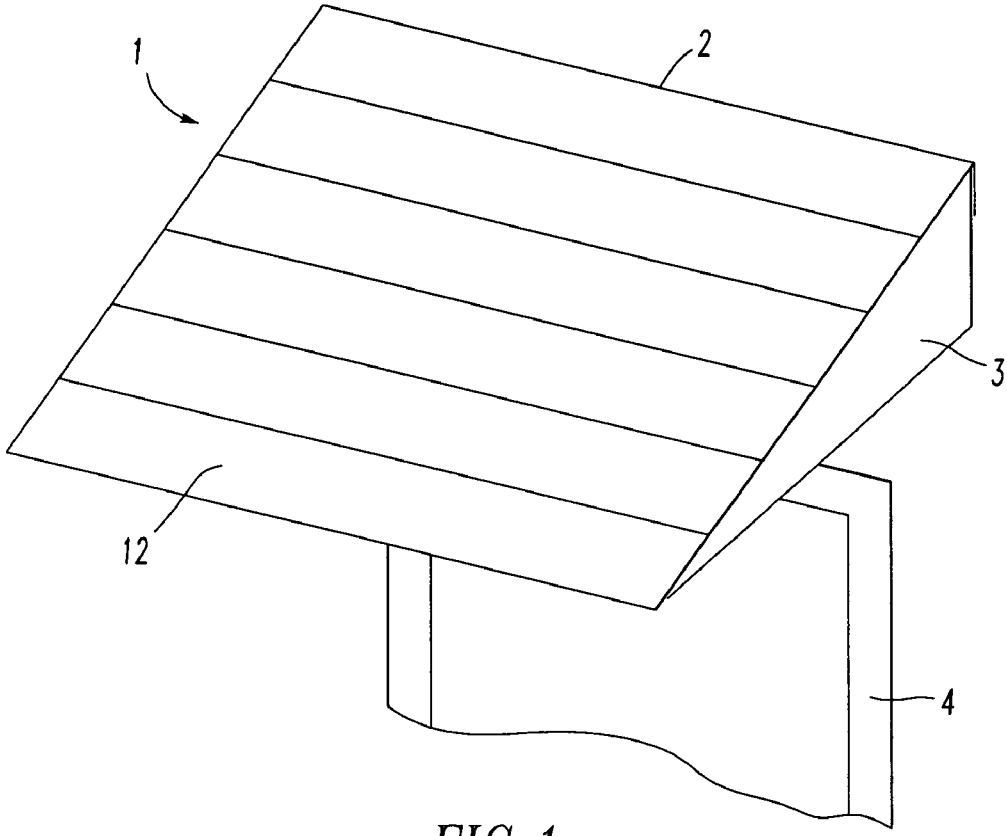
FIG. 1 is a perspective view of a first present preferred embodiment of my molded plastic canopy mounted above an exterior door.
Figure 2:
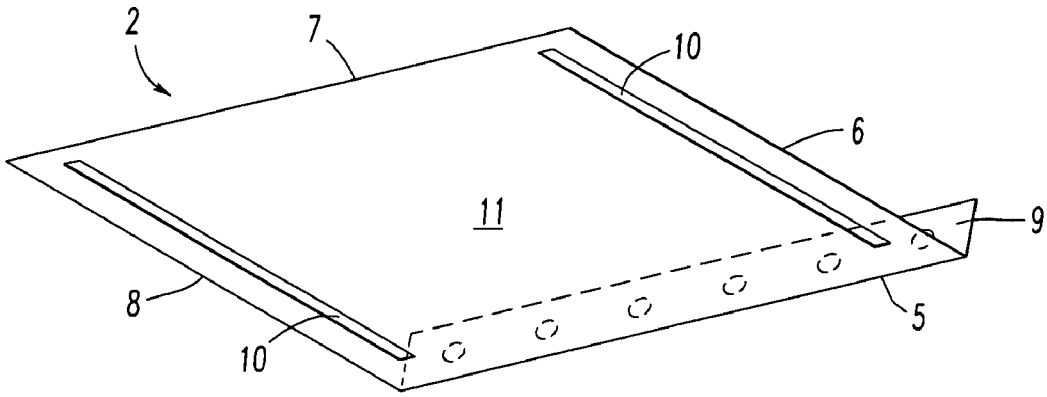
FIG. 2 is a perspective view showing the bottom of the roof used in the canopy of FIG. 1.
Figure 3:
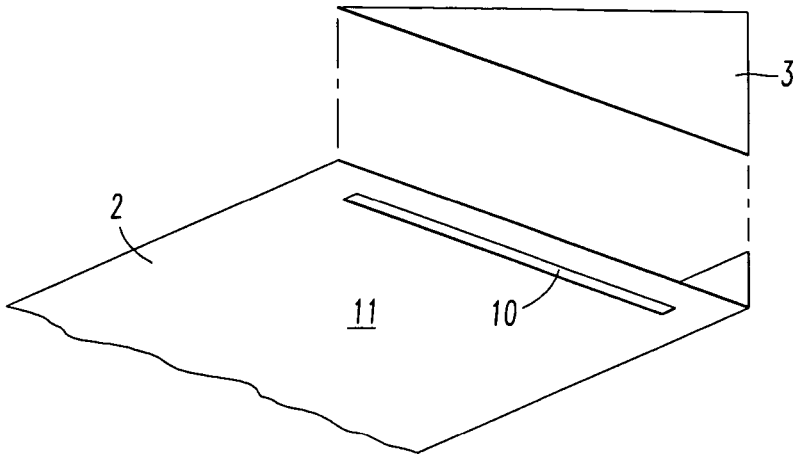
FIG. 3 is a fragmentary view showing a portion of a sidewall being attached to the roof shown in FIG. 2.

Referring to FIGS. 1, 2 and 3, a first present preferred embodiment 1 of my molded plastic canopy has a roof section 2 and two sidewalls 3, only one of which can be seen in FIG. 1. The canopy is mounted above a door 4, a portion of which can be seen in FIG. 1. As can be seen most clearly in FIG. 2, the roof section 2 is generally rectangular having four edges or sides 5, 6, 7 and 8. If desired, any and all of the sides 6, 7 and 8, as well as the roof section, could be curved. A mounting flange 9 is attached to one edge of the roof portion 2. Slots or sockets 10 are provided in the bottom surface 11 of the roof portion 2. The bottom surface could be curved or flat. These slots 10 receive a sidewall 3 as shown in FIG. 3. The slots or sockets are preferably molded into the roof portion. I prefer that the top surface 12 of the roof be molded to simulate a shingled roof, a shake roof, thatched roof, metal roof or tile roof. Typically, the roof 2 and sidewalls 3 would be molded from a plastic, preferably polypropylene. The roof may be molded from colored plastic. It may or may not be painted.

The canopy shown in FIG. 1 is mounted on an exterior wall utilizing flange 9 shown in FIG. 2. One may use screws or nails to attach flange 9 to the exterior wall. Yet, another method would be to mount a rail or board on the exterior wall then insert the flange behind that rail or board. The fastener may be as simple as "L" hooks that are secured into the studs and the roof rests, removably or permanently, onto the upright "L" portion of the hooks. One may also provide fasteners that attach to the roof or sidewall and to the exterior wall on which the canopy is mounted. The fastener could be exterior to or inside the canopy. One could also use a pipe, telescoping pipe or other suitable structure to provide support for the canopy.

Figure 8:
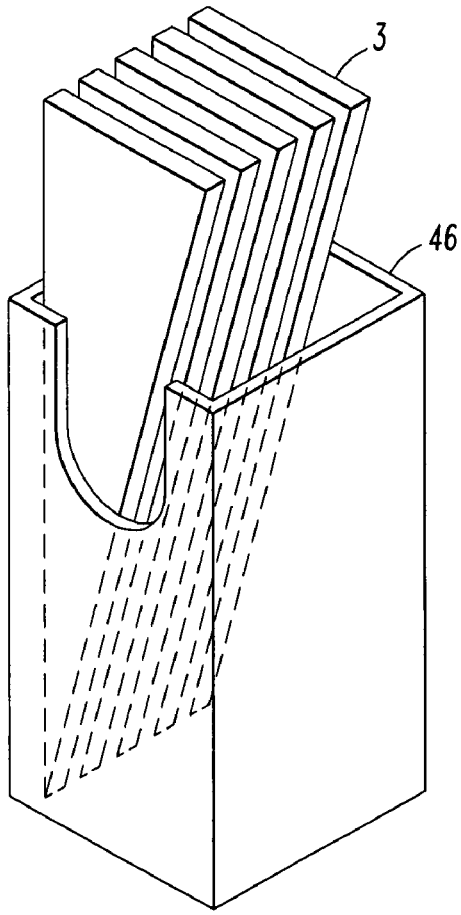
FIG. 8 is a perspective view of a cut box containing sidewalls for the embodiment shown in FIG. 5.
Figure 10:
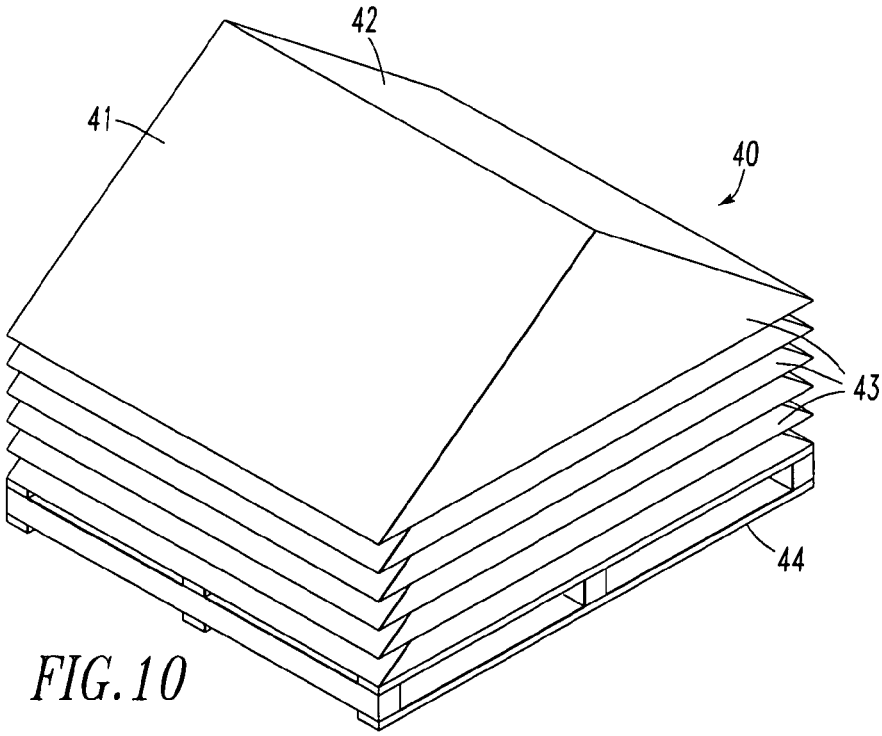
FIG. 10 is a perspective view showing several molded plastic canopies according to a third present preferred embodiment stacked on a pallet.
Figure 11:
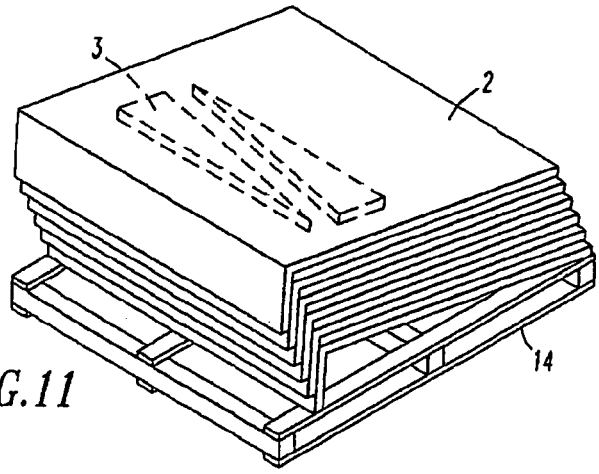
FIG. 11 is a perspective view showing several of the roof elements of the type shown in FIG. 2 stacked on a pallet.

The embodiment of FIG. 1 would be sold such that multiple roofs of the type shown in FIG. 2 would be stacked on pallet 14 shown in FIG. 10. The sidewalls 3 may be packaged separately in a cut box 46 as shown in FIG. 8 or preferably are secured to the top surface or bottom surface of the roof 2 as indicated by the dotted lines in FIG. 11. One may also package with the sidewalls the mounting rail and screws or other hardware required to mount the roof on an exterior wall. The roof, sidewalls and hardware may be shrink-wrapped together. This kit would be relatively light, weighing less than 20 pounds, and can easily be positioned above a door using no specialized tools. Most homeowners would be able to assemble and mount the roof within a few hours or less.

So that the roof is sloped when attached to exterior wall the flange 9 must be at an acute angle relative to the bottom surface 11 of the roof 2. Typically that angle would be between 35° and 55°.

Figure 4:
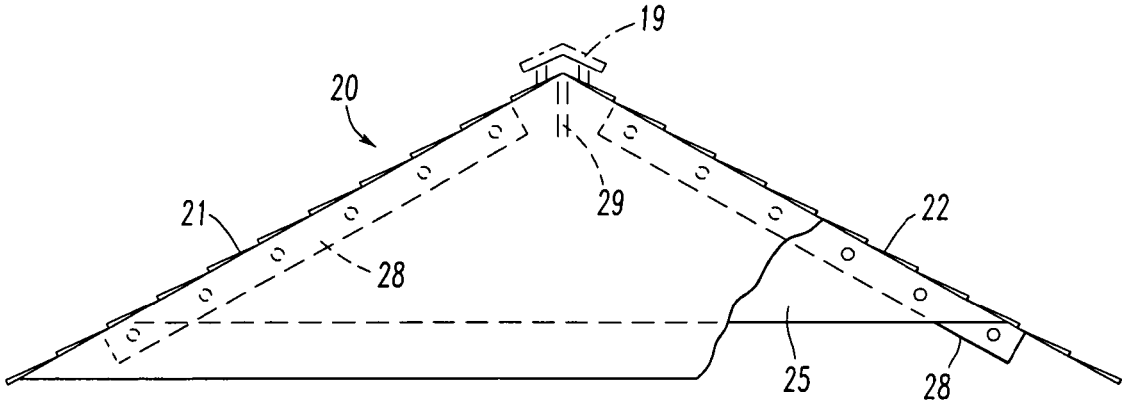
FIG. 4 is a front view of a second present preferred embodiment of my molded plastic canopy.

One can create a peak roof using two of the roof assemblies 2 shown in FIG. 2 and assembling them together as shown in FIG. 4. In this roof 20 there are two roof sections 21 and 22 similar to the roof 2 shown in FIG. 2. The two roof sections 21 and 22 are positioned so that mounting flanges 29 abut one another and are secured together by bolts or adhesive or other means. Sidewall 27 extends between roof sections 21, 22. I prefer to provide parallel triangular sidewalls 37, 38 which may also serve as braces. If desired the sidewalls may have a scalloped edge 36 shown in dotted line in FIG. 5 or other ornamental features. A mounting flange 28 is provided on each roof section for attaching the canopy to an exterior wall. These flanges could fit over a triangular fastener 25 attached to the exterior wall. The bottom of the roof could be curved or flat. One could also provide an insert that is attached to the underside of the roof to create a curved or dome ceiling for the canopy. This insert may also be attached to the wall of the building to which the canopy is attached. One may provide a socket 35 shown in dotted line in FIG. 5 to which a light fixture 39 may be attached. One may also provide a cross beam or other support (not shown) between roof sections 21 and 22. If provided, such a beam could hold light fixtures or light emitting diodes to provide illumination. If desired, the light fixture could be placed under the roof sections within the canopy.

My canopies are preferably molded from polycarbonate, polyvinyl chloride or ABS plastic. Since heat will accumulate under the canopy adjacent the roof, I prefer to provide a vent in the canopy. A ridge vent 19 shown in FIGS. 4 and 5 can be provided by attaching an inverted V-shaped cap over a space between roof sections 21 and 22 along the ridge line. This space can be created by placing spacers between the flanges 29 of the two roof sections 21, 22.

Figure 5:
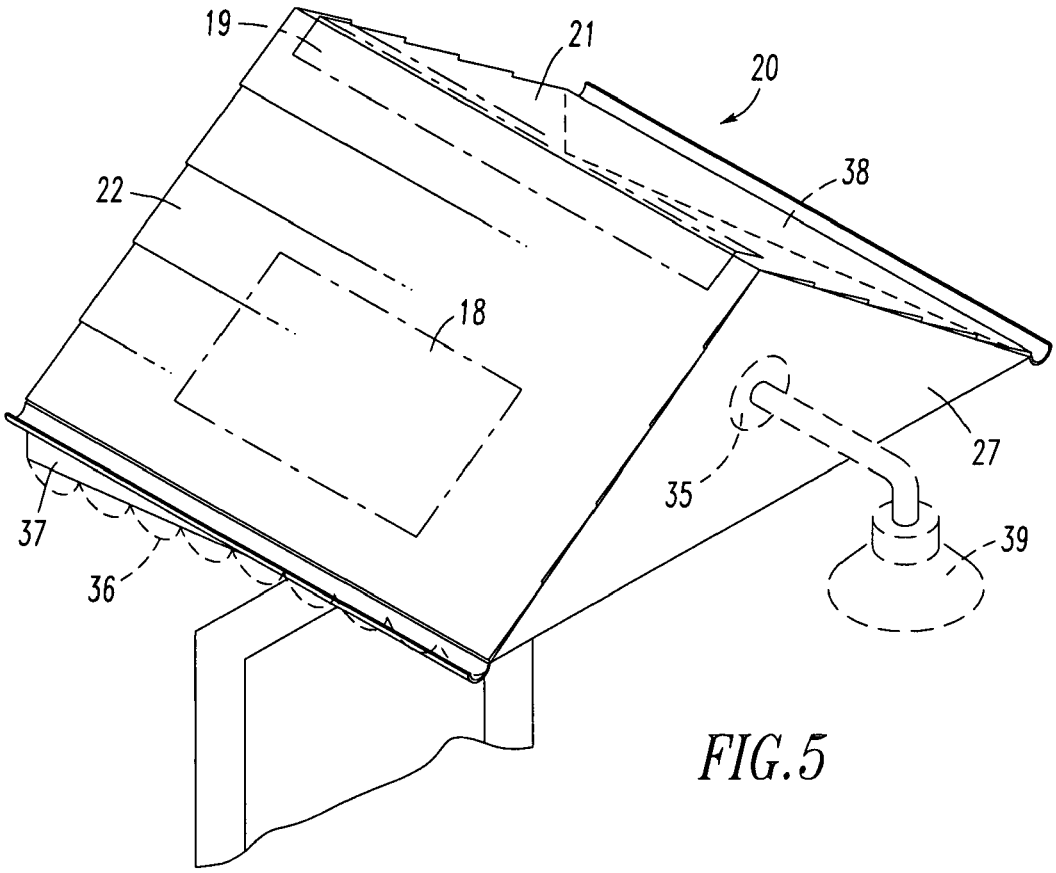
FIG. 5 is a perspective view of the embodiment shown in FIG. 4 mounted above a door.

I also may provide a solar cell 18 shown in chain line on FIG. 5 on one or both roof sections. The solar cell can be molded into the roof sections or attached onto areas of the roof section that may be specially configured to receive them. The solar cell may be used to charge a battery that powers sensors, camera(s), light fixture(s) or light emitting diodes in, on or wired to the canopy for safety, security, decorative, or commercial purposes. One could also provide a wind generator in place of, or in addition to, the solar cell for charging the battery.

Figure 6:
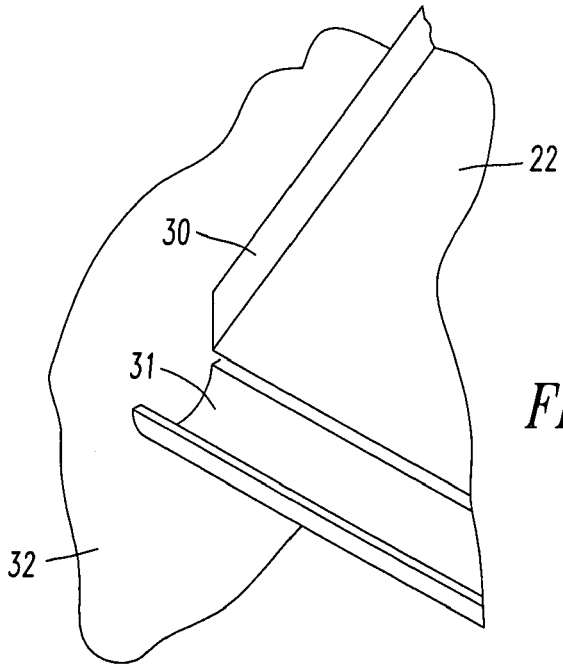
FIG. 6 is a fragmentary view of a portion of the embodiment shown in FIGS. 4 and 5 illustrating an optional gutter and web portion.
Figure 7:
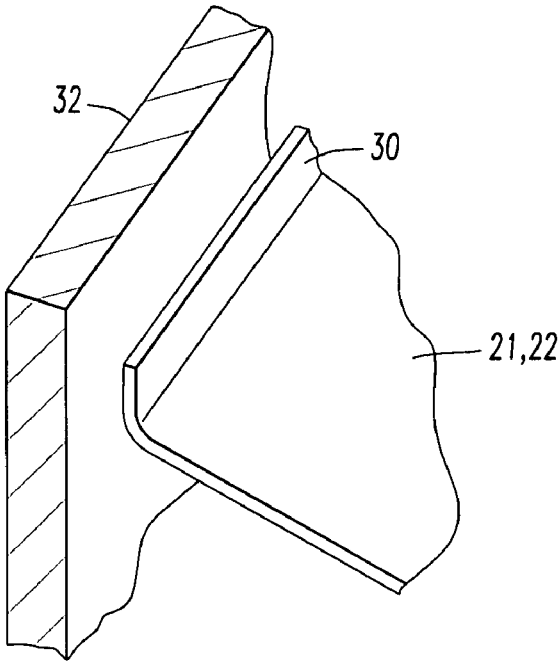
FIG. 7 is a fragmentary view showing a portion of the roof attached to an exterior wall.

As shown in FIGS. 6 and 7, I prefer to provide a flexible web 20 along the edge of the roof 21, 22. The web will press against the exterior wall 32 of a building. A similar web may be provided for the embodiment of FIG. 1 that could be inserted underneath the edge of shingles to provide a seal. I also prefer to prefer to provide a gutter 31 along one or more of the edges of the roof. One could make the gutter flow toward the front of the house, or may have the water fall directly off the sides, or, especially on larger canopies, one might want the water to run toward the house, and run down a small downspout. To do this, one could mold a removable cover, and also a downspout connector, into the gutter. A downspout would then go into the connector or the hole formed after the cover is removed and collect the water shed by the roof. In place of the gutter one could provide a raised edge or wall adjacent the edges of the roof which is angled or sloped to divert water toward the front or rear of the canopy.

An embodiment similar to the embodiment shown in FIGS. 4 and 5 could be made by forming the two roof sections 21, 22, the sidewall 27 and mounting flanges as a single piece. This embodiment 50 shown in FIG. 9 has two roof sections 51, 52 and a sidewall that are integrally molded as a single piece. Flanges (not shown) may be provided along the edge of the roof for attaching the canopy to an exterior wall. A decorative shape 54 is attached to or molded as part of sidewall 53. This insert could contain a lock, bell or other functional feature. One could also provide a birdhouse, or several nesting compartments, 64 shown in dotted line within the canopy with the opening to the birdhouse being provided in the insert 63 or directly in the sidewall 53 if no insert is used. A pair of decorative and/or support rails 55 extends from the lower edges of the roof to the exterior wall adjacent the door frame. These rails may telescope or have extenders 27 that can be added or removed to change the length of the rails 55. I may provided a slot or socket molded into the bottom of the roof section which receives the rail 55. The socket could alternatively be used for a vertical support that extends to the ground. The roof has a gutter 58 which slopes toward a connector 59 near the house. A downspout 60 is fitted to the connector 59. If a vertical support is used, the downspout may be positioned adjacent that support. The support could be four by four boards, metal poles or molded plastic structures. It could be very plain or intricately shaped.

Figure 9:
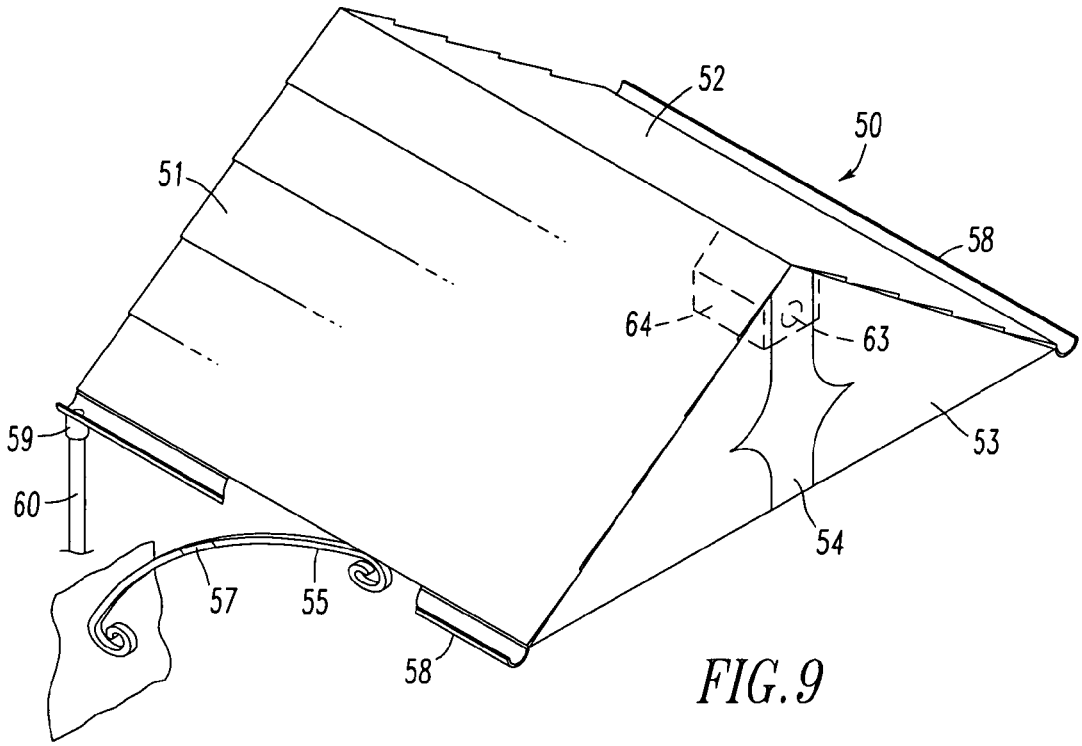
FIG. 9 is a perspective view of a third present preferred embodiment mounted above an exterior door.

Several such canopies 20, 50 are shown in FIG. 9 stacked on a pallet 44. To enable the canopies to nest the sidewall 27, 53 is flush with the edges of the roof sections. Furthermore, the sidewall slopes outward somewhat from top to bottom such that the angle between the sidewall and the roof sections along a vertical plane will be greater than ninety degrees. This configuration enables the canopies to nest as shown in FIG. 10.

Figure 12:
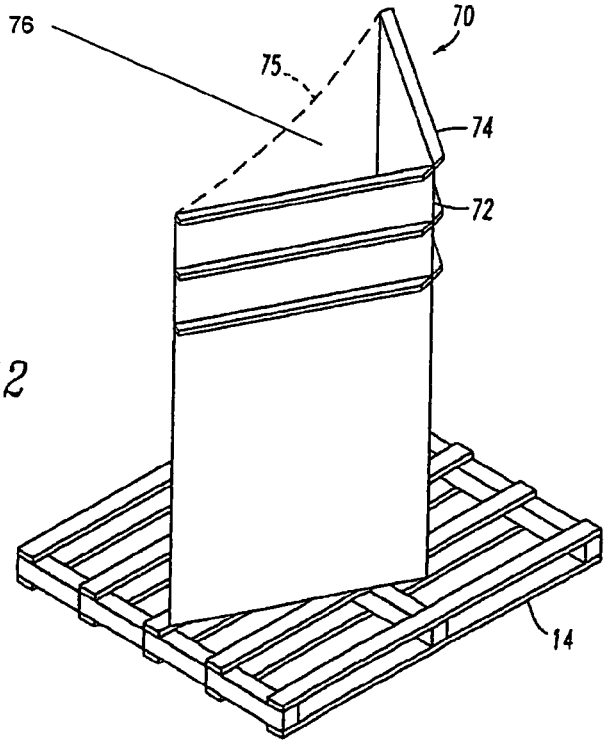
FIG. 12 is a perspective view showing several molded plastic canopies according to a fourth present preferred embodiment stacked on a pallet.

Several canopies 70 made in accordance with a fourth present preferred embodiment are shown in FIG. 12 stacked on a pallet 14. This canopy is similar to the embodiment of FIGS. 5 or 10 having a peak roof 72. In this embodiment mounting flanges 74 extend upward from the roof 72 rather than inward as in the previous embodiments. This embodiment may have a ceiling 75 shown in dotted line that could be flat or curved. This embodiment has a triangular sidewall, similar to sidewalls 27 and 43, which cannot be seen in FIG. 12. The area of this triangular sidewall is smaller than the area of the triangular opening 76 at the opposite end of the canopy 70. For example, one could make the horizontal base of the triangular opening 30 inches at the closed end where the sidewall is located and make the horizontal base of the open triangular end 32 inches. Consequently, the canopies can be nested and easily stacked on a pallet 14. When this canopy is attached to an exterior wall, the roof 72 will slope away from that wall. It should be apparent from the drawings that the orientation of the flange relative to the bottom surface and top surface of the roof is such that the flange can be mounted flush against an exterior wall or other vertical surface.

Figure 13:
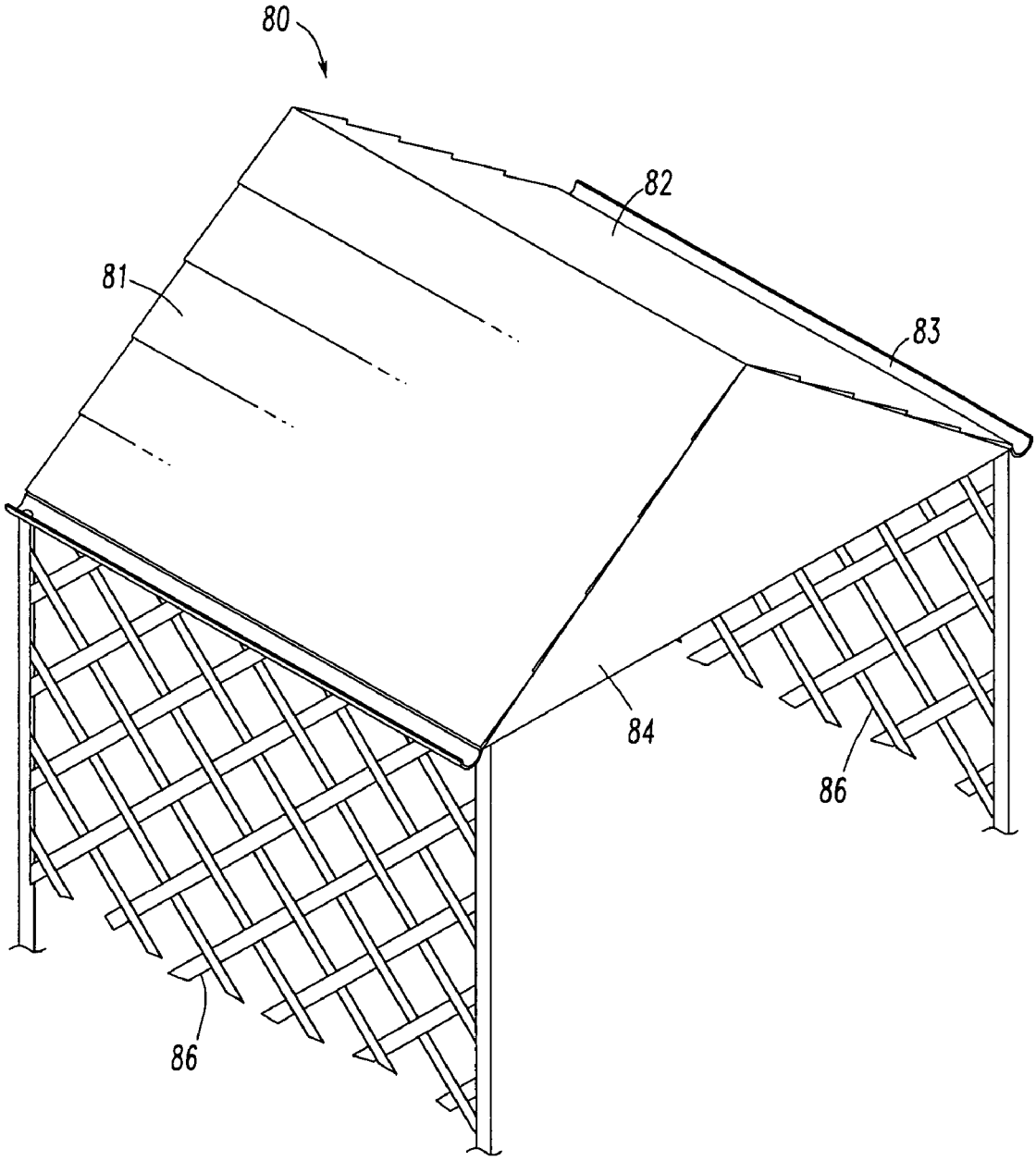
FIG. 13 is a perspective view of a fourth present preferred embodiment.

A fourth present preferred embodiment of my molded plastic canopy 80, shown in FIG. 13, has a peaked roof with roof sections 81 and 82. A triangular sidewall 84 extends between the roof sections. A molded gutter 85 is provided along the edge of each roof section 81, 82. In this embodiment a lattice 86 extends from each roof section. The lattice could be snap fit into the roof and extend to the ground. If desired, only one lattice could be used. As in the previous embodiments mounting flanges which cannot be seen in FIG. 13 extend downward from the edges of roof sections 81, 82 opposite sidewall 84.

The molded plastic canopy disclosed here is shown as being installed over a single exterior door. However, use of the canopy is not so limited. The canopy could be hung over a window or area desired to be protected from sun and rain or over an interior door. Furthermore, multiple canopies could be used on a single building. One or more of the canopies shown in FIG. 5 may be attached together to provide a longer area of protection. Larger canopies or multiple canopies could be used to cover a porch or patio. Attachment devices may be molded into each canopy to provide a place for supports that carry the weight of the canopy down to appropriate ground structures, footers, or foundations.

Although I have shown and described certain present preferred embodiments of my molded plastic canopy it should be distinctly understood that the invention is not limited thereto, but may be variously embodied within the scope of the following claims.

I claim:

1. A canopy comprised of:

a roof having a top surface, a bottom surface, a first edge, a second edge generally parallel to the first edge, a third edge and a fourth edge generally parallel to the third edge;

a first sidewall having a bottom edge, a top edge, the top edge being non-parallel to the bottom edge, an inside surface and an outside surface, the top edge of the first sidewall being attached to the roof along the first edge of the roof;

a mounting flange having an inside surface and an outside surface attached to one of the second edge of the roof and the third edge of the roof in a manner so that an angle between the inside surface of the mounting flange and the bottom surface of the roof enables the flange to be mounted flush against a substantially vertical surface;

wherein the roof, first sidewall and mounting flange are integrally molded plastic and are configured to enable one canopy to be nested and stacked on the roof of another canopy and the outside surface of the mounting flange to be surface mounted onto a planar surface; and a socket molded into at least one of the bottom surface and the sidewall.

2. A canopy comprised of:

a roof having a top surface, a bottom surface, a first edge, a second edge generally parallel to the first edge, a third edge and a fourth edge generally parallel to the third edge;

a first sidewall having a bottom edge, a top edge, the top edge being non-parallel to the bottom edge, an inside surface and an outside surface, the top edge of the first sidewall being attached to the roof along the first edge of the roof;

a mounting flange having an inside surface and an outside surface attached to one of the second edge of the roof and the third edge of the roof in a manner so that an angle between the inside surface of the mounting flange and the bottom surface of the roof enables the flange to be mounted flush against a substantially vertical surface; and a flexible member attached to one end of the roof and positioned to abut a wall on which the canopy is mounted;

wherein the roof, first sidewall and mounting flange are integrally molded plastic and are configured to enable one canopy to be nested and stacked on the roof of another canopy and the outside surface of the mounting flange to be surface mounted onto a planar surface.

3. A canopy comprised of:

a roof having a top surface, a bottom surface, a first edge, a second edge generally parallel to the first edge, a third edge and a fourth edge generally parallel to the third edge;

a first sidewall having a bottom edge, a top edge, the top edge being non-parallel to the bottom edge, an inside surface and an outside surface, the top edge of the first sidewall being attached to the roof along the first edge of the roof;

a mounting flange having an inside surface and an outside surface attached to one of the second edge of the roof and the third edge of the roof in a manner so that an angle between the inside surface of the mounting flange and the bottom surface of the roof enables the flange to be mounted flush against a substantially vertical surface;

wherein the roof, first sidewall and mounting flange are integrally molded plastic and are configured to enable one canopy to be nested and stacked on the roof of another canopy and the outside surface of the mounting flange to be surface mounted onto a planar surface;

a second roof having a top surface, a bottom surface, a first edge, a second edge generally parallel to the first edge, a third edge and a fourth edge generally parallel to the third edge;

a second sidewall having a bottom edge, a top edge, a top edge being non-parallel to the bottom edge, an inside surface and an outside surface, the top edge of the second sidewall being attached to the second roof along the first edge of the second roof; and a second mounting flange having an inside surface and an outside surface attached to one of the second edge of the roof and the third edge of the roof in a manner so that an angle between the inside surface of the second mounting flange and the bottom surface of the second roof is an acute angle, the second mounting flange being attached to the mounting flange attached to the roof; and wherein the second roof, second sidewall and second mounting flange are integrally molded plastic and configured to enable one canopy to be stacked on the first roof and second roof of another canopy the outside surface of the second mounting flange to be surface mounted onto a planar surface;

wherein a space is provided between the mounting flange and the second mounting flange and also comprising a vent cap extending over the space.

4. A canopy comprised of:

a roof having a top surface, a bottom surface, a first edge, a second edge generally parallel to the first edge, a third edge and a fourth edge generally parallel to the third edge;

a first sidewall having a bottom edge, a top edge, the top edge being non-parallel to the bottom edge, an inside surface and an outside surface, the top edge of the first sidewall being attached to the roof along the first edge of the roof; and a mounting flange having an inside surface and an outside surface attached to one of the second edge of the roof and the third edge of the roof in a manner so that an angle between the inside surface of the mounting flange and the bottom surface of the roof enables the flange to be mounted flush against a substantially vertical surface;

wherein the roof, first sidewall and mounting flange are integrally molded plastic and are configured to enable one canopy to be nested and stacked on the roof of another canopy and the outside surface of the mounting flange to be surface mounted onto a planar surface; and a fastener connected to at least one of the roof and the sidewall, the fastener configured for attachment to a wall.

5. The canopy of claim 4 wherein the fastener is a bracket having an L-shape or a triangular shape.

6. A canopy comprised of:

a roof having a top surface, a bottom surface, a first edge, a second edge generally parallel to the first edge, a third edge and a fourth edge generally parallel to the third edge;

a first sidewall having a bottom edge, a top edge, the top edge being non-parallel to the bottom edge, an inside surface and an outside surface, the top edge of the first sidewall being attached to the roof along the first edge of the roof; and a mounting flange having an inside surface and an outside surface attached to one of the second edge of the roof and the third edge of the roof in a manner so that an angle between the inside surface of the mounting flange and the bottom surface of the roof enables the flange to be mounted flush against a substantially vertical surface;

wherein the roof, first sidewall and mounting flange are integrally molded plastic and are configured to enable one canopy to be nested and stacked on the roof of another canopy and the outside surface of the mounting flange to be surface mounted onto a planar surface; and at least one of a solar cell and a wind generator attached to or molded into the roof.

7. The canopy of claim 6 also comprising a battery connected to at least one of the solar cell and the wind generator and at least one of a light fixture and a light emitting diode.

8. A canopy comprised of:

a roof having a top surface, a bottom surface, a first edge, a second edge generally parallel to the first edge, a third edge and a fourth edge generally parallel to the third edge;

a first sidewall having a bottom edge, a top edge, the top edge being non-parallel to the bottom edge, an inside surface and an outside surface, the top edge of the first sidewall being attached to the roof along the first edge of the roof; and a mounting flange having an inside surface and an outside surface attached to one of the second edge of the roof and the third edge of the roof in a manner so that an angle between the inside surface of the mounting flange and the bottom surface of the roof enables the flange to be mounted flush against a substantially vertical surface;

wherein the roof, first sidewall and mounting flange are integrally molded plastic and are configured to enable one canopy to be nested and stacked on the roof of another canopy and the outside surface of the mounting flange to be surface mounted onto a planar surface; and at least one of a decorative insert, nesting compartments and a bird house connected to the sidewall.

9. A canopy comprised of:

a peak roof having a front edge, a rear edge, and a bottom surface;

a sidewall attached to the front edge of the peaked roof such that an angle between the sidewall and the bottom surface of the peaked roof is an obtuse angle;

at least one mounting flange is attached to the rear edge of the peaked roof;

wherein the peaked roof, sidewalls and mounting flange are integrally molded plastic and configured to enable one canopy to be nested and stacked on another canopy; and a flexible member attached to one end of the roof and positioned to abut a wall on which the canopy is mounted.

10. A canopy comprised of:

a peak roof having a front edge, a rear edge, and a bottom surface;

a sidewall attached to the front edge of the peaked roof such that an angle between the sidewall and the bottom surface of the peaked roof is an obtuse angle;

at least one mounting flange is attached to the rear edge of the peaked roof;

wherein the peaked roof, sidewalls and mounting flange are integrally molded plastic and configured to enable one canopy to be nested and stacked on another canopy;

a flexible member attached to one end of the roof and positioned to abut a wall on which the canopy is mounted; and at least one of a decorative insert, nesting compartments and a bird house connected to the sidewall.

11. A canopy comprised of:

a peak roof having a front edge, a rear edge, and a bottom surface;

a sidewall attached to the front edge of the peaked roof such that an angle between the sidewall and the bottom surface of the peaked roof is an obtuse angle;

at least one mounting flange is attached to the rear edge of the peaked roof;

wherein the peaked roof, sidewalls and mounting flange are integrally molded plastic and configured to enable one canopy to be nested and stacked on another canopy; and a flexible member attached to one end of the roof and positioned to abut a wall on which the canopy is mounted and at least one lattice extending from the peaked roof.

* * * * *